US010501909B1

(12) United States Patent
Phaneuf

(10) Patent No.: US 10,501,909 B1
(45) Date of Patent: Dec. 10, 2019

(54) FRENCH DRAIN STYLE DRAINAGE SYSTEM

(71) Applicant: Tobie Phaneuf, Gatineau (CA)

(72) Inventor: Tobie Phaneuf, Gatineau (CA)

( * ) Notice: Subject to any disclaimer, the term of this patent is extended or adjusted under 35 U.S.C. 154(b) by 0 days.

(21) Appl. No.: 16/052,807

(22) Filed: Aug. 2, 2018

(51) Int. Cl.
*E02D 31/02* (2006.01)
*E02B 11/00* (2006.01)

(52) U.S. Cl.
CPC ..... *E02D 31/02* (2013.01); *E02B 11/00* (2013.01)

(58) Field of Classification Search
CPC ..... E02D 31/02; E02B 11/00
See application file for complete search history.

(56) References Cited

U.S. PATENT DOCUMENTS 460,352 A 9/1891 Reading
463,871 A 11/1891 Reading
2,663,997 A 12/1953 Schmidt et al.
2,750,232 A 6/1956 Szantay et al.
3,333,422 A 8/1967 Neyland
4,065,925 A 1/1978 Auriemma
4,095,618 A 6/1978 Spencer
4,385,727 A 5/1983 Spencer
4,538,386 A * 9/1985 DiCello ..... E02D 31/02 405/43
5,444,950 A * 8/1995 Kelly ..... E02D 19/00 405/43
5,501,044 A * 3/1996 Janesky ..... E04B 1/7023 404/4
5,586,416 A * 12/1996 Hess, III ..... E02D 19/00 249/5
6,179,007 B1 1/2001 Cote
6,230,468 B1 * 5/2001 Klaus ..... E02D 31/06 405/39
6,517,283 B2 2/2003 Coffey
6,634,144 B1 * 10/2003 Moore ..... E02D 31/02 405/38
6,904,723 B1 * 6/2005 Moore ..... E02D 31/02 454/341
8,186,127 B1 * 5/2012 Pratt ..... E02D 31/02 52/169.5
9,758,944 B2 * 9/2017 Parks ..... E02D 31/025
2006/0150551 A1 * 7/2006 Bounds ..... E04B 1/7023 52/302.1

(Continued)

FOREIGN PATENT DOCUMENTS

DE 19704165 A1 * 8/1998 ..... E01C 3/06

*Primary Examiner* — Benjamin F Fiorello

(57) ABSTRACT

A French drain style drainage system that resolves water infiltration problems is provided. The system includes French drain style pipes with flaps on both sides wherein a first row of perimeter pipes is laid at the foundation footing level with perforations at the bottom half of the pipe circumference, below the flap so that water below the footing will be collected and the flap which overlaps the foundation creates an effective seal preventing water from creeping upward. A second row of perimeter pipes located just under the ground surface also has flaps on both sides, wherein one flap makes contact with the side of the building and perforations are located on the upper half of the pipe, above the flaps so as to collect surface water. Joining the upper external flap to the lower external flap is a waterproof membrane which creates a dry zone between the two rows of perimeter pipes proximal to the house foundation.

8 Claims, 4 Drawing Sheets

(56) References Cited

U.S. PATENT DOCUMENTS

| | | | | |
|---|---|---|---|---|
| 2008/0025795 | A1* | 1/2008 | Purnell | E02D 31/02 405/36 |
| 2009/0208345 | A1* | 8/2009 | Moore | F04D 15/0077 417/6 |
| 2013/0071186 | A1* | 3/2013 | Ekern | E02B 11/00 405/45 |

* cited by examiner

FRENCH DRAIN STYLE DRAINAGE SYSTEM

CROSS-REFERENCE TO RELATED APPLICATIONS

N/A

BACKGROUND OF THE INVENTION

1. Field of the Invention

The present invention relates generally to drainage systems but more particularly to a French drain style drainage system.

2. Description of Related Art

French drains have been in use for well over a century and they collect water that accumulates around a building at the level of the foundation. However, they do not solve all the problems related to water around a building as there is still water infiltration happening at the foundation level of buildings. Consequently, there is a need for a French drain style drainage system that offers an improvement over existing French drains.

BRIEF SUMMARY OF THE INVENTION

In one embodiment of the present invention a French drain style drainage system is provided, comprising a foundation footing; a foundation extending vertically from the foundation footing; a first French drain pipe having first perforations positioned at a top half circumference of the first French drain pipe; a second French drain pipe having second perforations positioned at a bottom half circumference of the second French drain pipe; a first pair of flaps having a first proximal flap and a first distal flap, wherein the first proximal flap extends horizontally from the first French drain pipe to the foundation, and the first distal flap extends horizontally from the first French drain pipe opposite the first proximal flap; and, a second pair of flaps having a second proximal flap and a second distal flap, wherein the second proximal flap extends horizontally from the second French drain pipe to the foundation footing, and the second distal flap extends horizontally from the second French drain pipe opposite the second proximal flap.

In another aspect of the invention, a French drain style drainage system is provided, comprising a foundation footing; a foundation extending vertically from the foundation footing; a first French drain pipe having first perforations positioned at a top half circumference of the first French drain pipe; a second French drain pipe having second perforations positioned at a bottom half circumference of the second French drain pipe; a first pair of flaps having a first proximal flap and a first distal flap, wherein the first proximal flap extends horizontally from the first French drain pipe to the foundation, and the first distal flap extends horizontally from the first French drain pipe opposite the first proximal flap; and, a second pair of flaps having a second proximal flap and a second distal flap, wherein the second proximal flap extends horizontally from the second French drain pipe to the foundation footing, and the second distal flap extends horizontally from the second French drain pipe opposite the second proximal flap; wherein the first French drain pipe is positioned above the second French drain pipe in a vertical plane; wherein the first pair of flaps is parallel to the second pair of flaps, and the first and second pair of flaps are configured to create a seal to prevent water from creeping downwards and upwards respectively between the first and second pair of flaps.

In one embodiment, at least one vertical pipe in fluid connectivity with the first and second French drain pipe is provided. In one embodiment, a membrane configured to provide a dry area between the first and second French drain pipe is provided. In another embodiment, the membrane is positioned perpendicular to the first and second pair of flaps. In one embodiment, the membrane is constructed from waterproof materials. In one embodiment, loose aggregates lining an exterior surface of the membrane are provided. In another embodiment, a plurality of handles along the first and second French drain pipe is provided to facilitate the initial installation of the system. In yet another embodiment, the first pair of flaps is positioned just under the ground surface.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a French drain style drainage system 10.

Figure 1:
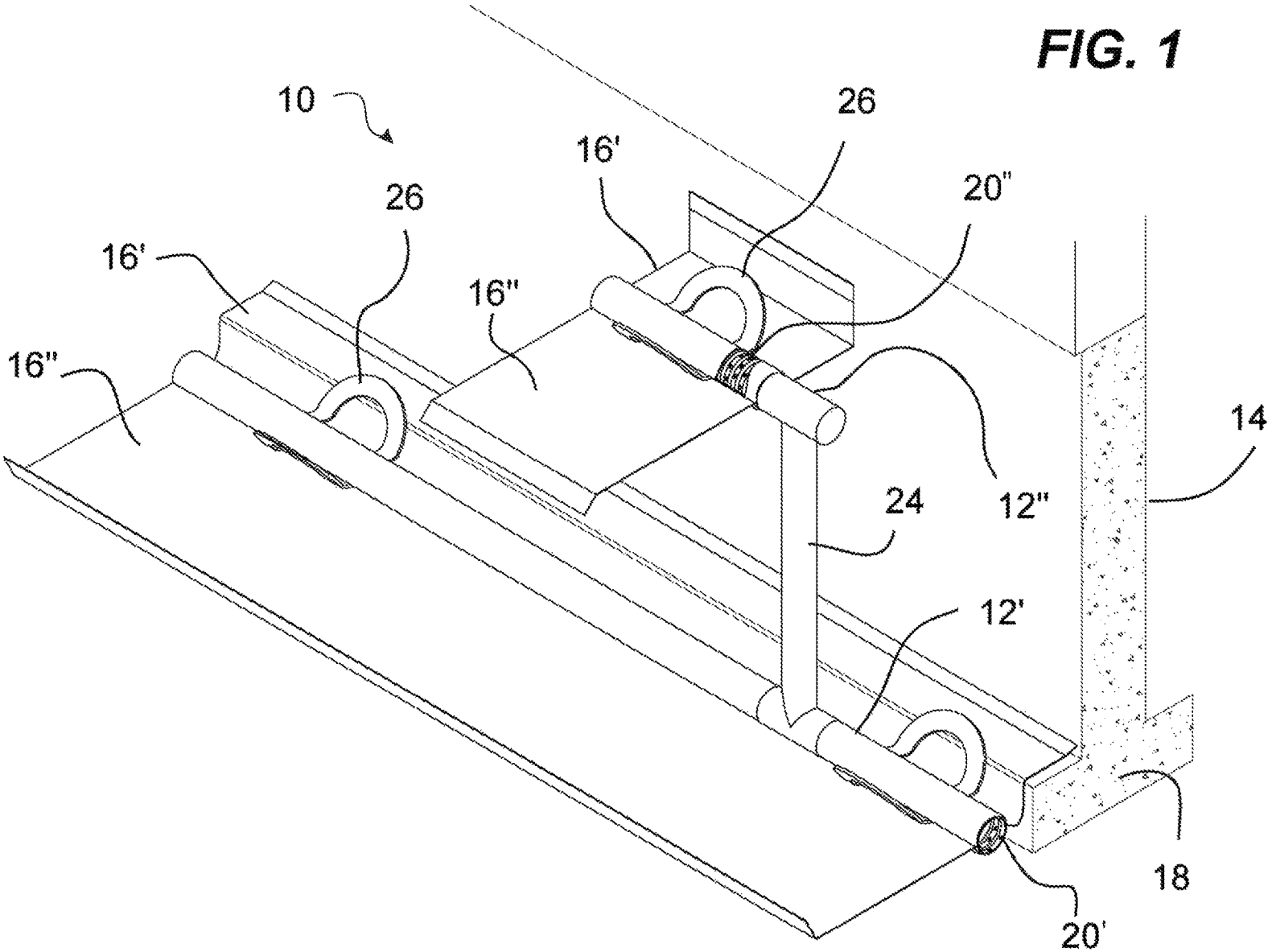
FIG. 1 is an isometric view of a French drain style drainage system according to an embodiment of the present invention.
Figure 2:
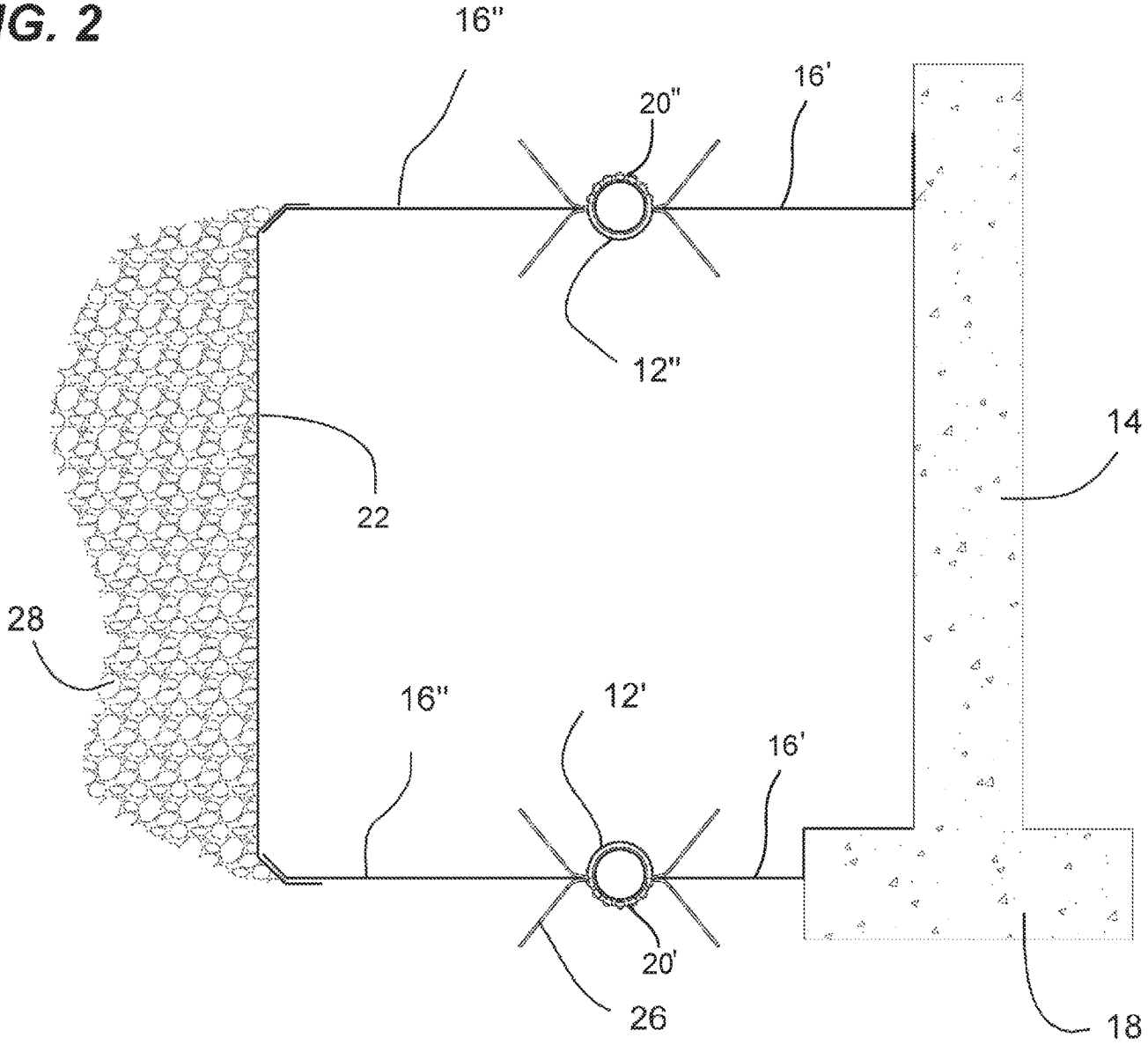
FIG. 2 is a cutaway front view of the French drain style drainage system.
Figure 3A:
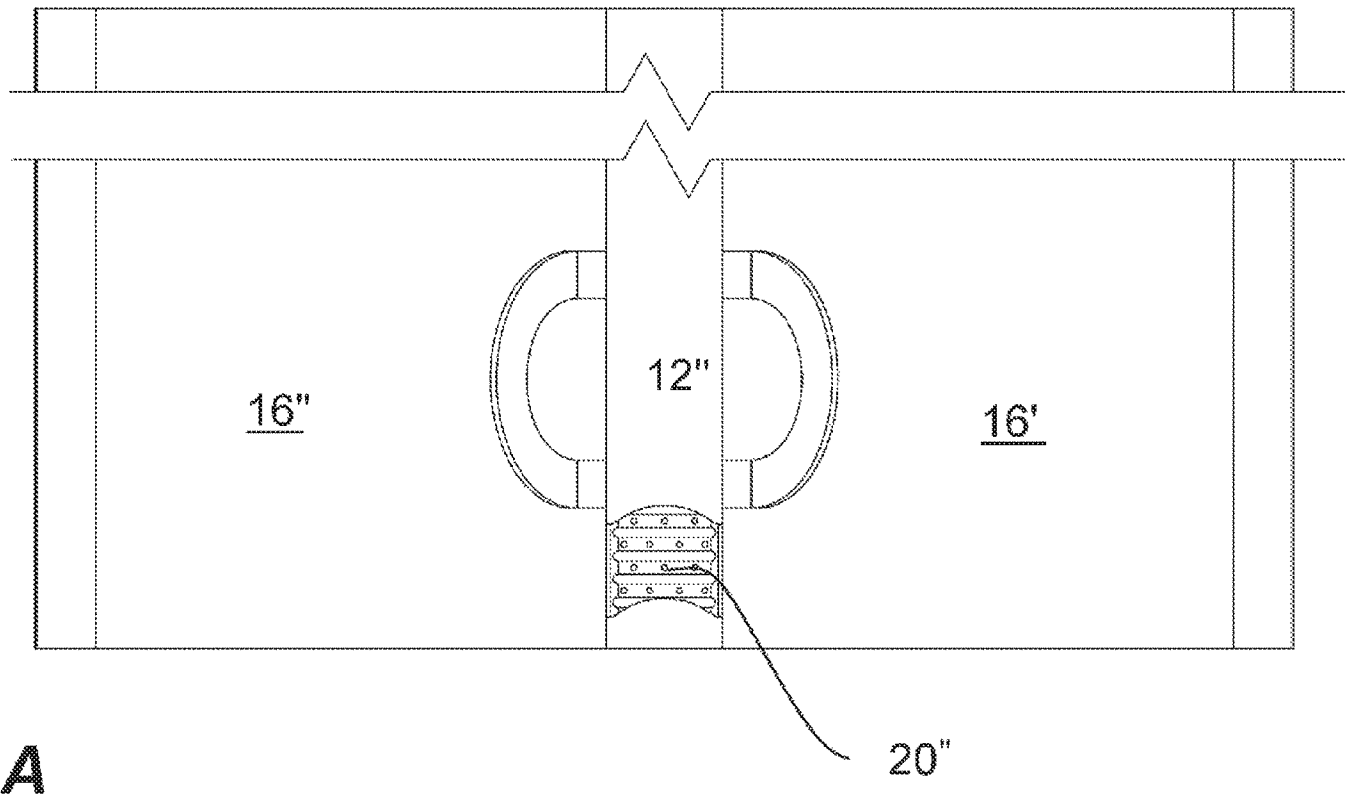
FIG. 3A is a top view of the French drain style drainage system according to an embodiment of the present invention.
Figure 3B:
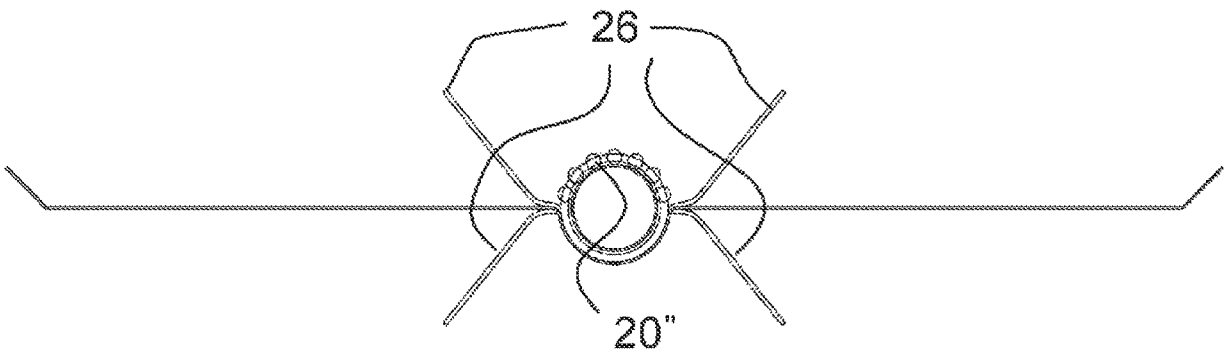
FIG. 3B is a front view of the French drain style drainage system showing the upper French drain pipe according to an embodiment of the present invention; and, FIG. 4 is a cutaway isometric view of the French drain style drainage system according to an embodiment of the present invention.
Figure 4:
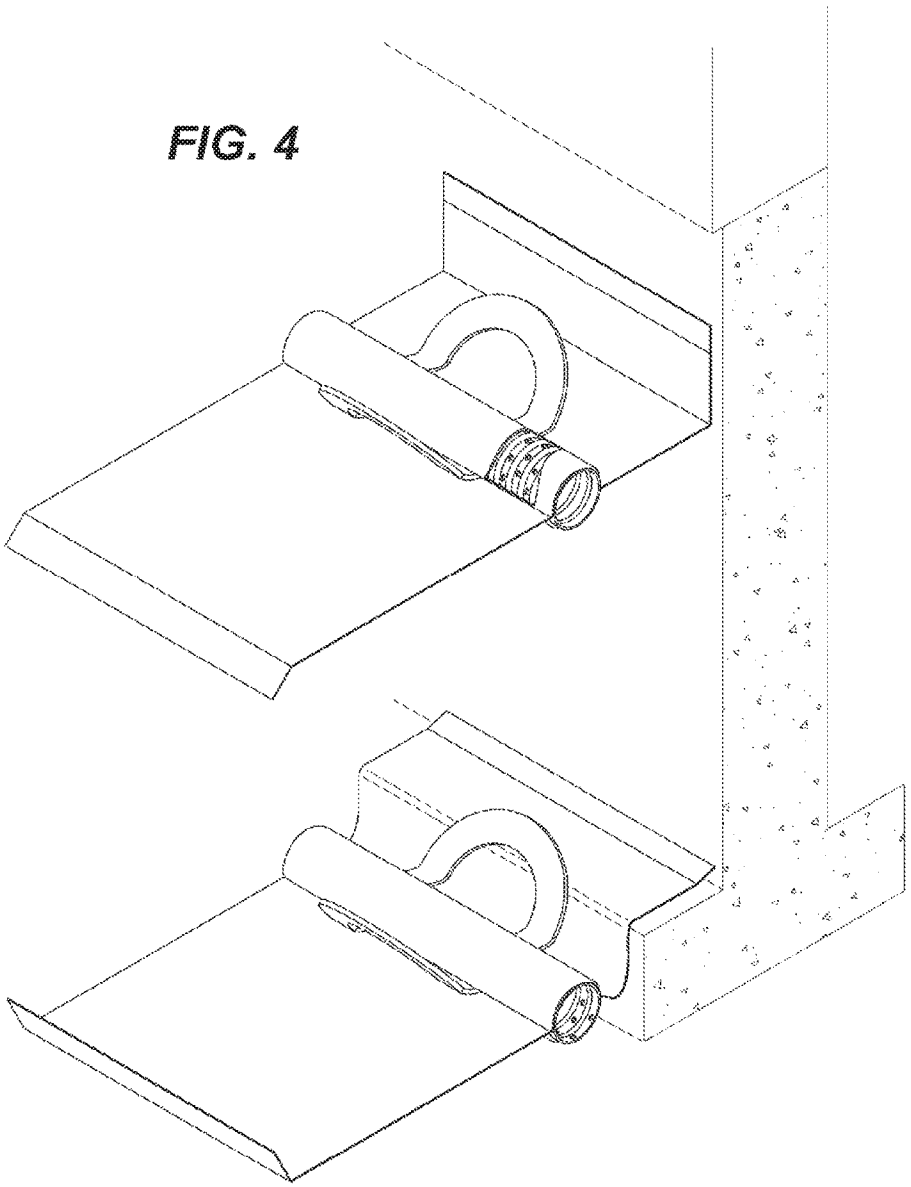

Referring now to any of the accompanying FIGS. 1-4, the present invention comprises a at least one French drain pipe (12' and 12") having a pair of flaps 16' and 16", wherein each flap extends radially from opposing sides of the at least one French drain pipe. In one embodiment, two French drain pipes 12' and 12" are provided, wherein a first French drain pipe 12" is positioned in an upper position and a second French drain pipe 12' is positioned in a lower position relative to foundation 14. In one embodiment, the first and second French drain pipes extend around the perimeter of the foundation. In one embodiment, the second French drain pipe is positioned adjacent to foundation footing 18 and the first French drain pipe is positioned above the second French drain pipe in the same vertical plane. In one embodiment, the first and second French drain pipe may be comprised of multiple connected pipes forming single pipes as well known in the art.

In one embodiment, the pair of flaps comprise a proximal flap 16' extending to the foundation and a distal flap 16" extending away from the foundation. It is a particular advantage of the present invention, that the second French drain pipe includes second perforations 20' positioned at the bottom half of the pipe circumference, i.e. below the pair of flaps such that any water present below the foundation footing will be collected via the second perforations and the pair of flaps create an effective seal preventing water from creeping upwards. Similarly, the first French drain pipe includes first perforations 20" positioned at the top half of the pipe circumference, i.e. above the pair of flaps such that any water present above the pair of flaps (surface water) will be collected via the first perforations and the pair of flaps create an effective seal preventing water from creeping downwards. In one embodiment, the pair of flaps radially extend from the first French drain pipe and are positioned just under the ground surface (not illustrated).

In one embodiment, a membrane 22 (best seen in FIG. 2) is configured to provide a dry area between the first and second French drain pipe. The membrane is positioned perpendicularly to the pair of flaps and is constructed from waterproof materials. Specifically, the membrane is positioned perpendicularly at the end of the upper and lower distal flap. In one embodiment, the end of each distal flap is angled and configured to match an opposite angled surface of the membrane providing a seal. In one embodiment, loose aggregates 28 are provided to accelerate the flow of surface water down to the second French drain pipe. In one embodiment, the loose aggregates line the exterior surface of the membrane (best seen in FIG. 2).

In one embodiment, at least one vertical pipe 24 is provided, wherein the at least one vertical pipe is in fluid connectivity with the first and second French drain pipes. In one embodiment, the at least one vertical pipe is configured to transfer the collected water in the first French drain pipe and transfer the collected water to the second French drain pipe where it may exit the drainage system below the foundation footing.

In one embodiment, a plurality of handles 26 is provided. The handles are provided along the first and second French drain pipe to facilitate the initial installation of the pipes. Depending upon the desired orientation of the perforations a given pair of handles is used, such that the first and second French drain pipe is constructed identically for ease of manufacturing.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A French drain style drainage system comprising:

a foundation footing;

a foundation extending vertically from the foundation footing;

a first French drain pipe having first perforations positioned at a top half circumference of the first French drain pipe;

a second French drain pipe having second perforations positioned at a bottom half circumference of the second French drain pipe;

a first pair of flaps having a first proximal flap and a first distal flap, wherein the first proximal flap extends horizontally from the first French drain pipe to the foundation, and the first distal flap extends horizontally from the first French drain pipe opposite the first proximal flap; and, a second pair of flaps having a second proximal flap and a second distal flap, wherein the second proximal flap extends horizontally from the second French drain pipe to the foundation footing, and the second distal flap extends horizontally from the second French drain pipe opposite the second proximal flap;

wherein the first French drain pipe is positioned above the second French drain pipe in a vertical plane;

wherein the first pair of flaps is parallel to the second pair of flaps, and the first and second pair of flaps are configured to create a seal to prevent water from creeping downwards and upwards respectively between the first and second pair of flaps.

2. The French drain style drainage system of claim 1, further comprising at least one vertical pipe in fluid connectivity with the first and second French drain pipe.

3. The French drain style drainage system of claim 1, further comprising a membrane configured to provide a dry area between the first and second French drain pipe.

4. The French drain style drainage system of claim 3, wherein the membrane is positioned perpendicular to the first and second pair of flaps.

5. The French drain style drainage system of claim 4, wherein the membrane is constructed from waterproof materials.

6. The French drain style drainage system of claim 3, further comprising loose aggregates lining an exterior surface of the membrane.

7. The French drain style drainage system of claim 1, further comprising a plurality of handles along the first and second French drain pipe to facilitate the initial installation of the system.

8. The French drain style drainage, system of claim 1, wherein the first pair of flaps is positioned under the ground surface.

* * * * *